US007855882B2

(12) United States Patent
Franz

(10) Patent No.: US 7,855,882 B2
(45) Date of Patent: Dec. 21, 2010

(54) FAN UNIT AND METHODS OF FORMING SAME

(75) Inventor: John P. Franz, Houston, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/344,111

(22) Filed: Dec. 24, 2008

(65) Prior Publication Data

US 2009/0104053 A1 Apr. 23, 2009

Related U.S. Application Data

(62) Division of application No. 10/827,965, filed on Apr. 19, 2004.

(51) Int. Cl.

| | |
|---|---|
| ***H05K 5/00*** | (2006.01) |
| ***H05K 7/20*** | (2006.01) |
| ***F01D 5/04*** | (2006.01) |
| ***F03B 7/00*** | (2006.01) |
| ***F04B 35/04*** | (2006.01) |
| ***F04B 39/06*** | (2006.01) |

(52) U.S. Cl. ..... 361/679.48; 417/366; 417/354; 415/58.2; 416/9; 361/695

(58) Field of Classification Search ..... 361/695, 361/679.48; 417/354, 366; 416/9; 415/58.2
See application file for complete search history.

(56) References Cited

U.S. PATENT DOCUMENTS

| | | | | | |
|---|---|---|---|---|---|
| 1,739,082 | A | * | 12/1929 | Simmons et al. | 454/346 |
| 2,951,634 | A | * | 9/1960 | Koch | 417/369 |
| 3,274,410 | A | * | 9/1966 | Boivie | 310/62 |
| 3,303,995 | A | * | 2/1967 | Boeckel | 417/353 |
| 3,385,516 | A | * | 5/1968 | Omohundro | 416/93 R |
| 3,449,605 | A | * | 6/1969 | Wilson | 310/58 |
| 3,848,145 | A | * | 11/1974 | Goebel et al. | 310/60 R |
| 3,882,335 | A | * | 5/1975 | Fries | 310/61 |
| 4,074,156 | A | * | 2/1978 | Widstrand et al. | 310/62 |
| 4,128,364 | A | | 12/1978 | Papst et al. | |
| 4,137,472 | A | * | 1/1979 | Workman | 310/61 |
| 4,210,833 | A | * | 7/1980 | Neveux | 310/58 |
| 4,583,911 | A | | 4/1986 | Braun | |
| 4,684,835 | A | * | 8/1987 | Kline et al. | 310/59 |
| 4,838,760 | A | * | 6/1989 | Brackett | 416/93 R |
| 4,917,572 | A | | 4/1990 | Van Houten | |
| 5,217,353 | A | * | 6/1993 | De Filippis | 417/368 |
| 5,245,236 | A | * | 9/1993 | Horng | 310/67 R |
| 5,257,902 | A | | 11/1993 | Atarashi et al. | |
| 5,749,704 | A | * | 5/1998 | Jerdee | 415/211.2 |
| 5,814,908 | A | * | 9/1998 | Muszynski | 310/62 |
| 5,944,497 | A | * | 8/1999 | Kershaw et al. | 417/423.8 |
| 5,967,764 | A | * | 10/1999 | Booth et al. | 417/423.8 |
| 6,107,708 | A | * | 8/2000 | Yamaguchi et al. | 310/58 |
| 6,130,491 | A | * | 10/2000 | Mitamura et al. | 310/62 |
| 6,227,822 | B1 | * | 5/2001 | Chen | 417/423.7 |
| 6,283,726 | B1 | * | 9/2001 | Fackelmann et al. | 417/366 |
| 6,345,956 | B1 | | 2/2002 | Lin | |

(Continued)

*Primary Examiner*—Jayprakash N Gandhi
*Assistant Examiner*—Bradley H Thomas

(57) ABSTRACT

The described embodiments relate to fan units. One exemplary fan unit includes a housing supporting a motor. The fan unit also includes an impeller coupled to the motor and configured to be rotated by the motor. The impeller comprises at least a first structure configured to move air past the housing and at least one second different structure configured to force air into the housing.

6 Claims, 11 Drawing Sheets

U.S. PATENT DOCUMENTS 6,379,116 B1 * 4/2002 Tai ..... 416/93 R
6,384,494 B1 * 5/2002 Avidano et al. ..... 310/58
6,461,124 B1 * 10/2002 Morelli ..... 417/423.8
6,682,320 B2 * 1/2004 Gold et al. ..... 417/368
6,773,239 B2 * 8/2004 Huang et al. ..... 417/354
6,813,149 B2 11/2004 Faneuf et al.
6,951,241 B1 * 10/2005 Gatley ..... 165/47
7,008,189 B2 3/2006 Jarrah et al.
7,066,712 B2 * 6/2006 Kim et al. ..... 415/58.4
7,078,834 B2 * 7/2006 Liu ..... 310/64
7,122,924 B2 * 10/2006 Lee ..... 310/62
7,244,110 B2 * 7/2007 Hong et al. ..... 417/368
7,300,262 B2 * 11/2007 Ku et al. ..... 417/366
7,345,386 B2 * 3/2008 Dano et al. ..... 310/61
7,455,502 B2 * 11/2008 Spaggiari ..... 416/93 R
2003/0142476 A1 7/2003 Tomioka et al.
2004/0096326 A1 5/2004 Chang et al.
2004/0101406 A1 * 5/2004 Hoover ..... 416/140
2005/0103042 A1 * 5/2005 Sanagi ..... 62/419
2005/0163614 A1 7/2005 Chapman
2006/0034055 A1 2/2006 Mok

* cited by examiner

FAN UNIT AND METHODS OF FORMING SAME

RELATED APPLICATIONS

This patent application claims priority to U.S. patent application Ser. No. 10/827,965, titled "FAN UNIT AND METHODS OF FORMING SAME", filed on 19 Apr. 2004, commonly assigned herewith, and hereby incorporated by reference.

BACKGROUND

Fan units are employed for creating air movement in many diverse environments. A fan unit can create air movement when an electric motor imparts mechanical energy to one or more fan blades. The electric motor generates heat that can affect a lifespan of the fan unit. Fan units are often employed in heated ambient environments which can exacerbate the heat issues of the fan unit.

BRIEF DESCRIPTION OF THE DRAWINGS

The same numbers are used throughout the drawings to reference like features and components wherever feasible.

DETAILED DESCRIPTION

Overview

The described embodiments relate to fan units having a means for cooling an internal environment of the fan unit. The fan units can comprise a housing and an impeller configured to rotate relative to the housing. The housing can define the internal environment or internal volume. The housing can support various electrical components, such as a motor, within the internal volume. The motor can provide the mechanical energy to rotate the impeller to create air movement around the housing. The impeller can also be configured to force air into, and through, the internal environment to increase heat dissipation of the internal environment.

Exemplary fan units can be employed in various applications. One such application positions a fan unit in or on a consumer device such a computer, server, printer or other device having electrical components which generate heat. The fan unit can be positioned within a housing of the consumer device to cool the consumer device by moving air through the consumer device. In such an implementation, the fan unit operates in a heated ambient environment within the consumer device.

Exemplary Embodiments

Figure 1A:
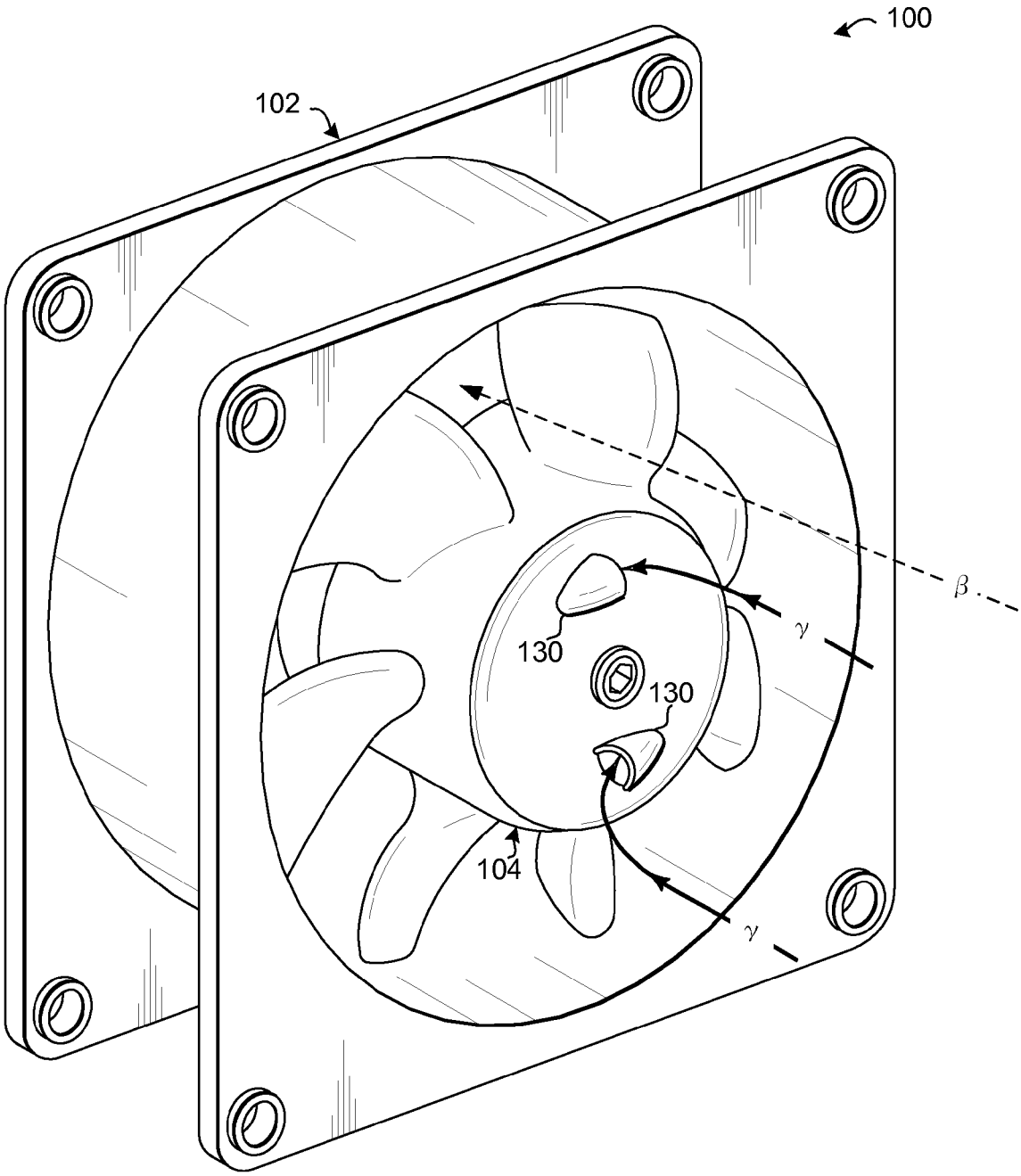
FIG. 1*a* illustrates a perspective view of an exemplary fan unit in accordance with one embodiment of the inventive concepts.
Figure 1B:
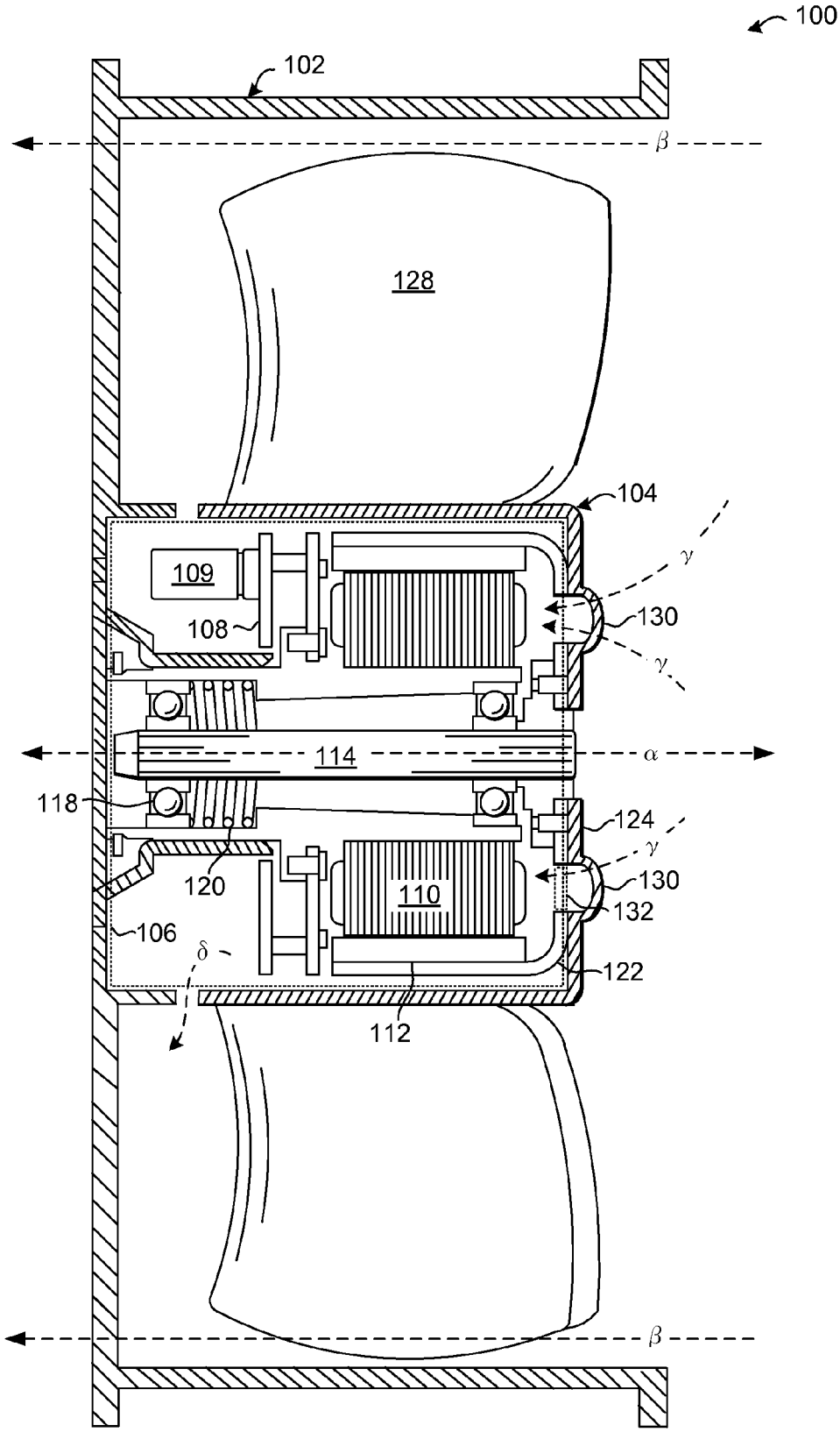
FIG. 1*b* illustrates a cross-sectional view of an exemplary fan unit in accordance with one embodiment of the inventive concepts.

FIGS. 1*a*-1*b* illustrate perspective and cross-sectional views respectively of an exemplary fan unit 100. This particular fan unit comprises a housing 102 and an impeller 104. Housing 102 supports various electrical components in an internal volume or environment indicated generally at 106. In this particular embodiment, examples of the various components supported by housing 102 can include a circuit board 108, a capacitor 109, a motor coil 110 and a motor magnet 112 among others. Circuit board 108 contains power regulators and control logic to the motor coil 110 and motor magnet 112 which drive a shaft 114. Bearings 118 support shaft 114. A spring 120 can absorb thrust from, and/or associated with, the shaft movement and maintain the shaft in a proper orientation. This is but one suitable motor means for imparting mechanical energy to the impeller. The skilled artisan should recognize other configurations.

Shaft 114 is coupled to a cup 122 which is coupled to impeller 104. The impeller comprises a hub 124 and a first structure configured to move air past housing 102. In this particular embodiment the first structure comprises multiple blades 128 extending radially from hub 124. The hub also has a second structure configured to force air into internal volume 106. In this embodiment the second structure comprises one or more scoops 130.

During operation, electrical energy can be supplied to circuit board 108. Motor coil 110 and motor magnet 112 can convert the electrical energy into mechanical energy that drive impeller 104. Circuit board 108, motor coil 110, motor magnet 112, and bearings 118 generate heat during operation. Heat production within the internal volume increases as the fan unit is operated at increasing revolutions per minute of the shaft/impeller.

Impeller 104 surrounds a portion of internal volume 106 such that with existing designs air movement from blades 128 does not generally enter internal volume 106 and as such does not provide a significant heat dissipation capacity. Further, the impeller may act as a thermal insulator which slows heat dissipation from internal volume 106. For example, impeller 104 can be constructed of various materials such as polymers, metals and composites. These materials can have a relatively low rate of heat dissipation, due at least in part, to their low thermal conductivity. Thus, existing designs can impede heat dissipation by blocking airflow through the internal volume and/or by surrounding some of the internal volume with a generally thermally-insulative material. The present embodiments can increase heat dissipation by forcing air into the internal volume through scoops 130. These embodiments allow increased heat dissipation regardless of the impeller composition. As such, the present embodiments can allow an impeller material to be selected based upon various factors such as cost and weight without concern for the thermal dissipation properties of the material. Alternatively or additionally, scoops 130 can provide increased airflow through the internal volume with increasing impeller revolution. Thus, the cooling capacity automatically increases with increased RPM and associated heat output. Though the description above relates to utilizing a single material to form the impeller it is equally applicable to other configurations. For example, the hub 124 could be formed from a first material, such as metal, which is joined to blades 128 formed from a second material, such as a polymer. Impeller 104 can be formed utilizing known processes such as injection molding.

In operation of the illustrated embodiment, impeller 104 can rotate around an axis of rotation a which passes through shaft 114. Rotation of impeller's blades 128 can create air movement past housing 102 as indicated generally by arrows β. Rotation of impeller 104 also causes scoops 130 to force air into internal volume 108 as indicated generally by arrows γ. Scoops 130 force air into the internal volume through respectively aligned holes 132 formed in cup 122. Air in internal volume 106 can exit through an exit space which will be described in more detail below. Air leaving the internal volume is indicated here generally by arrow δ.

Figure 1C:
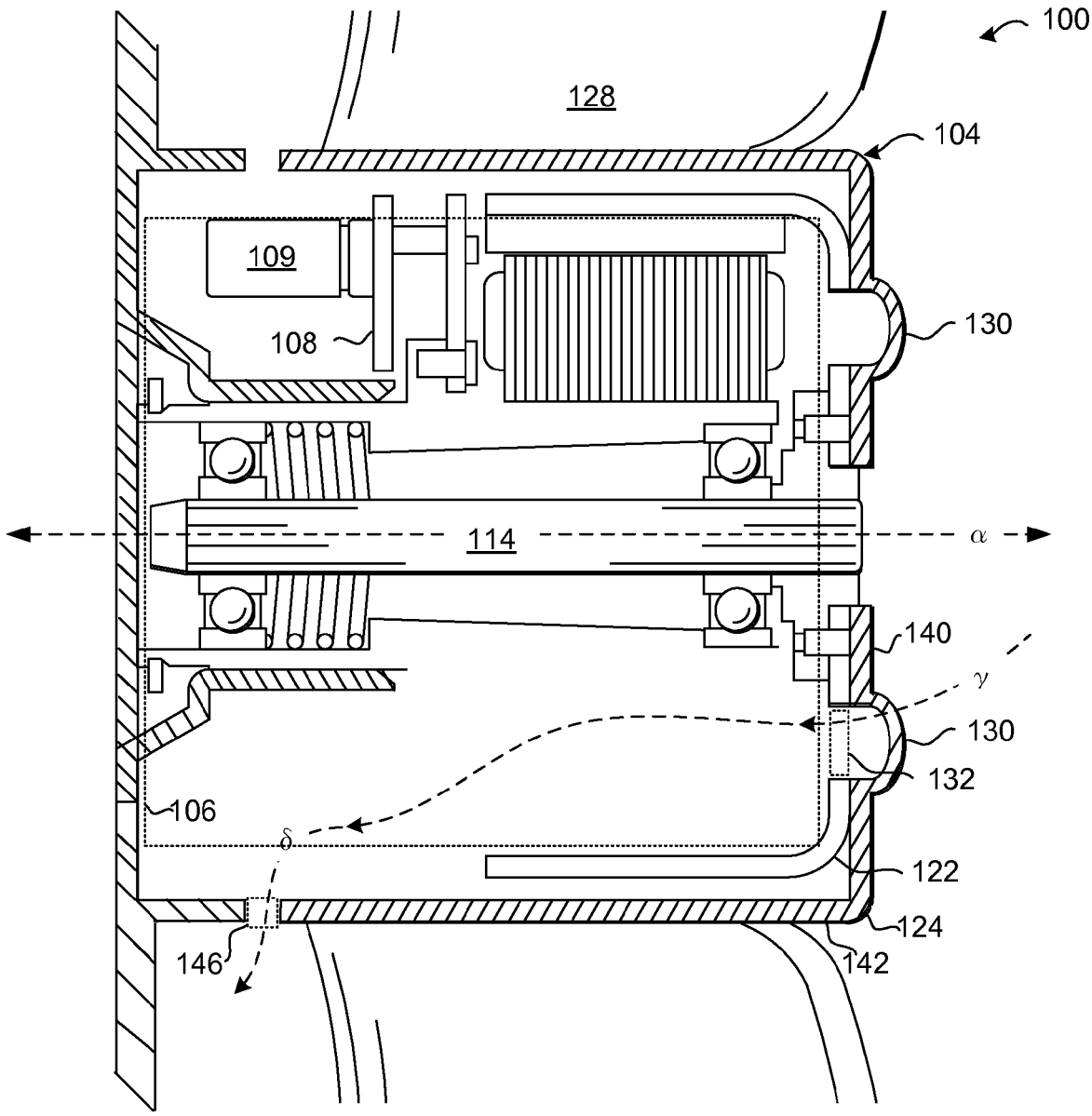
FIG. 1*c* illustrates a cross-sectional view of a portion of the exemplary fan unit illustrated in FIG. 1*b* in accordance with one embodiment.

The reader is now referred to FIG. 1*c* in combination with FIGS. 1*a*-1*b*. FIG. 1*c* illustrates a representation of a portion of fan unit 100. FIG. 1*c* is a cross-sectional view similar to that illustrated in FIG. 1*b* with some of the internal components of the fan unit removed for purposes of explanation. In this embodiment, hub 124 has a first surface 140 extending generally transverse to axis of rotation α and a second surface 142 which is generally parallel to the axis of rotation. In this embodiment, scoops 130 are formed in first surface 140 so that upon rotation, air can enter the scoops and pass through corresponding holes 132 to enter internal cavity 106. The air can then leave the internal cavity through an exit hole or space 146. In this instance the exit hole comprises a gap between impeller 104 and housing 102. Examples of other configuration are described below.

Figure 1D:
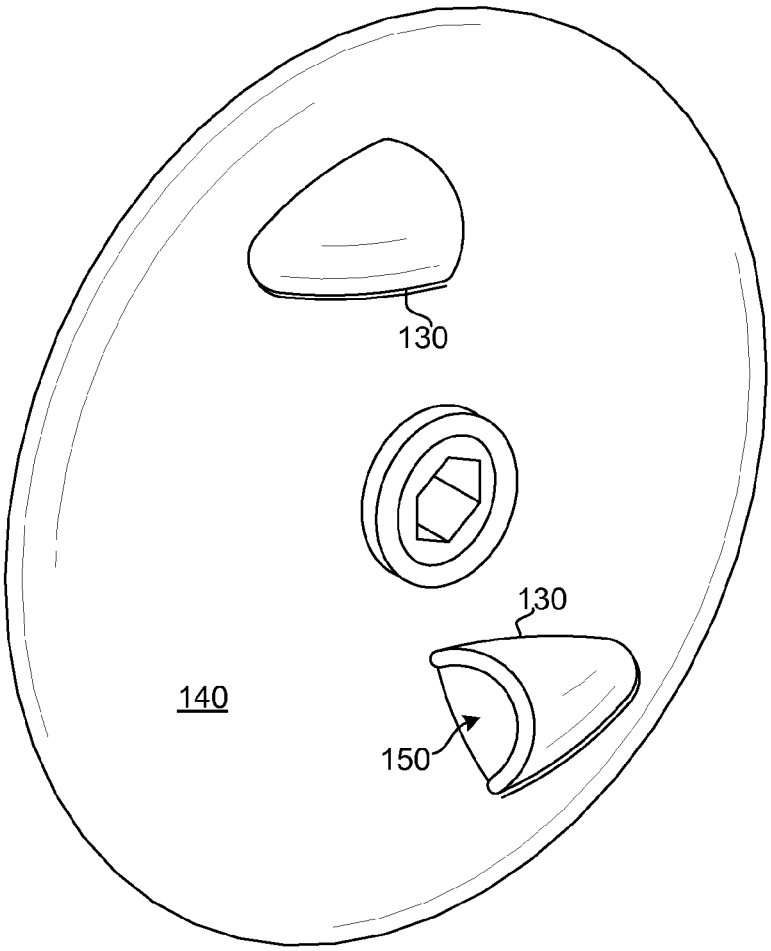
FIG. 1*d* illustrates a perspective view of a portion of the exemplary fan unit illustrated in FIG. 1*a* in accordance with one embodiment.
Figure 1E:
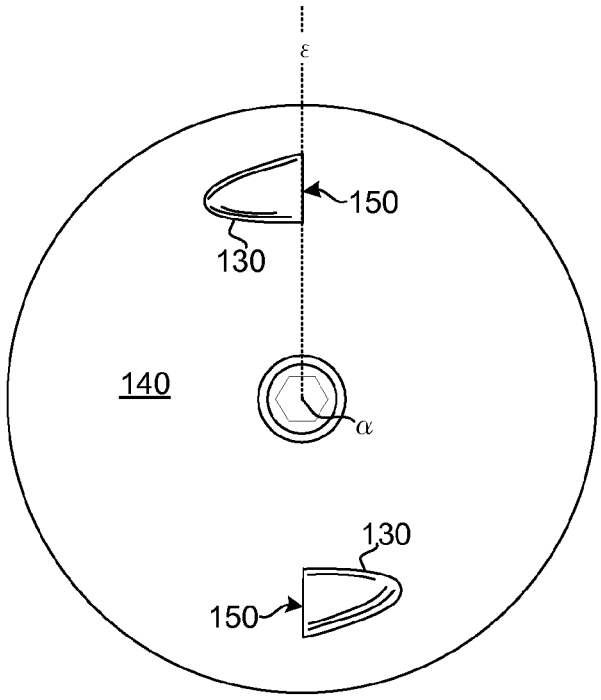
FIG. 1*e* illustrates a front elevational view of a portion of the exemplary fan unit illustrated in FIG. 1*a* in accordance with one embodiment.

FIGS. 1*d*-1*e* illustrate a representation of a perspective view and a front elevational view respectively, of the first surface 140 of the hub. In this embodiment, individual scoops 130 approximate a conoid that defines an opening 150. The opening is oriented generally radially relative to the hub's axis of rotation α such that air enters the opening generally orthogonally to axis α. In FIG. 1*e* the axis of rotation extends into and out of the page on which the figure appears. In this particular embodiment, the scoops are oriented along axis α such that each scoop is an inverse symmetrical relation to the other. A radial axis ϵ is provided in FIG. 1*e* for purposes of explanation. Examples of other scoop configurations are provided below.

The relative size of scoop openings 150 can be selected based upon various factors. For example, such factors may include the intended RPM of the fan unit, the intended ambient operating environment temperature of the fan unit, the number of scoops employed, among others. In some examples, the combined area of openings 150 can comprise approximately 5% to 50% of the surface area of first surface 140. In still other examples the combined openings can comprise approximately 10% to approximately 25% of the surface area of first surface 140.

Figure 2:
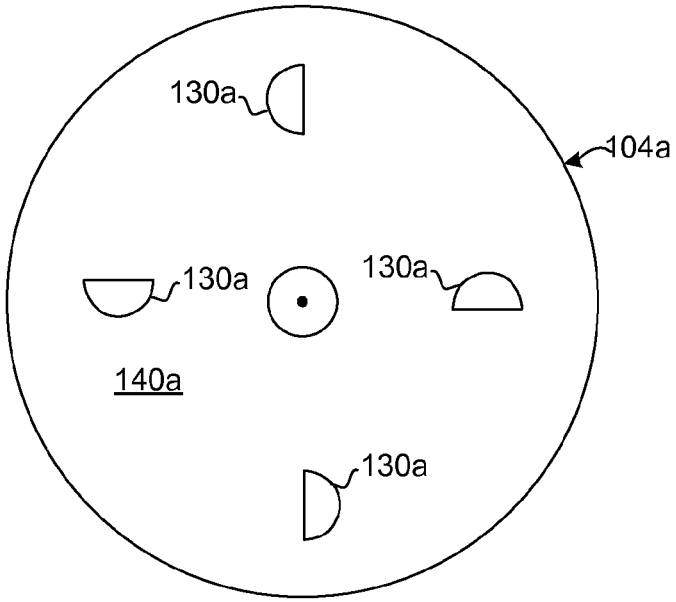
FIGS. 2-3 illustrate front elevational views of a portion of exemplary fan units in accordance with one embodiment of the inventive concepts.
Figure 3:
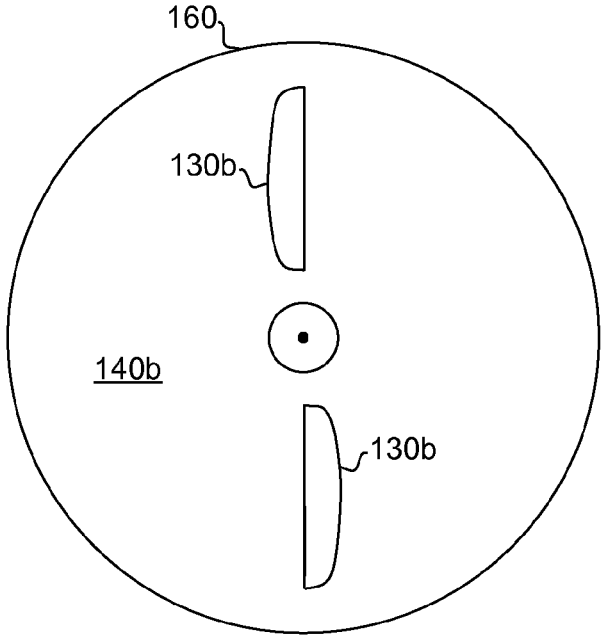

FIGS. 2-3 illustrate further examples of scoop configurations formed on a hub's first surface. FIG. 2 illustrates four generally hemispherical scoops 130*a* formed on first surface 140*a* of hub 104*a*. Similarly, FIG. 3 illustrates two scoops 130*b* which are relatively elongated between the axis of rotation α and an outer edge 160 of first surface 140*b*.

Figure 4:
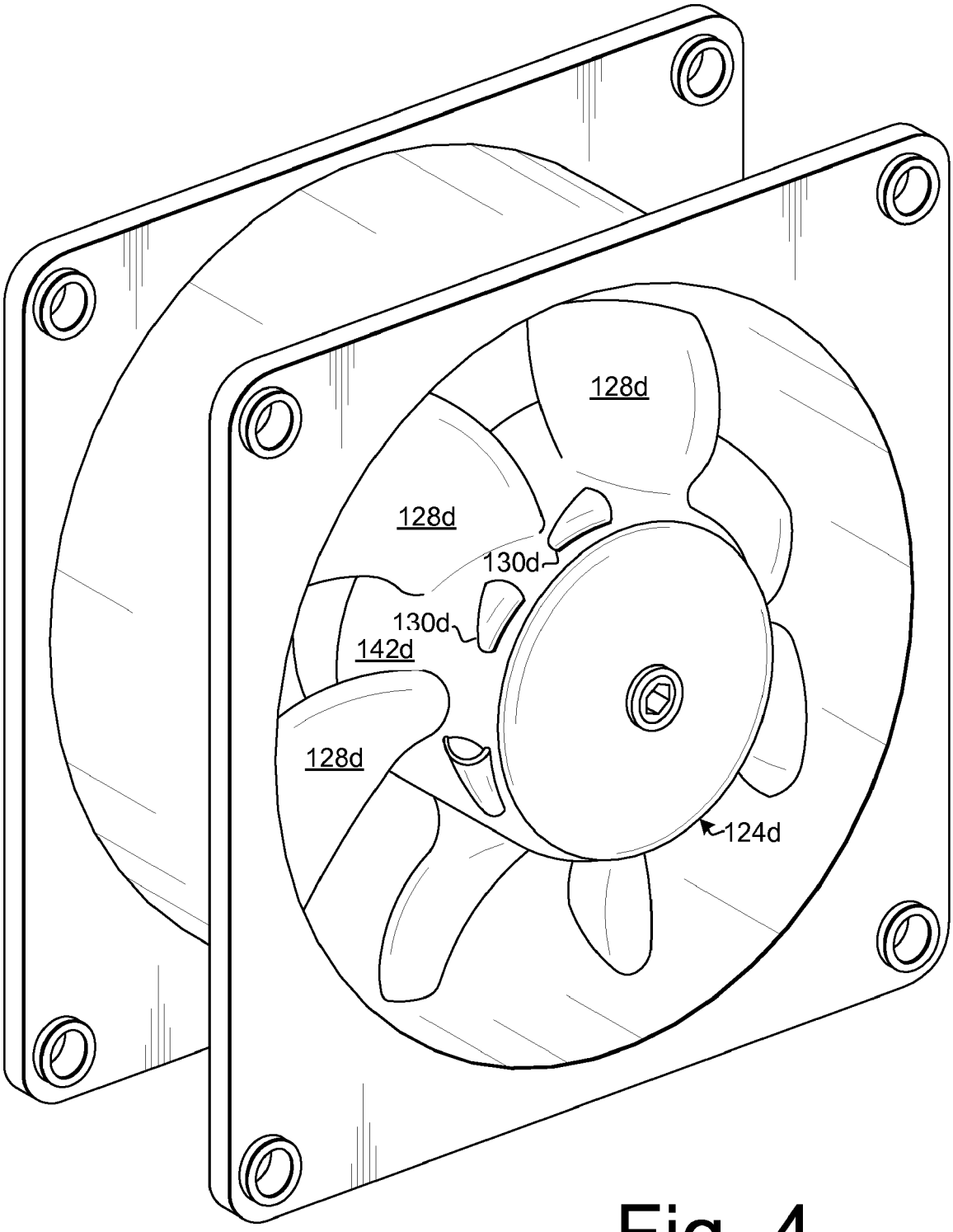
FIG. 4 illustrates a perspective view of an exemplary fan unit in accordance with one embodiment of the inventive concepts.
Figure 5A:
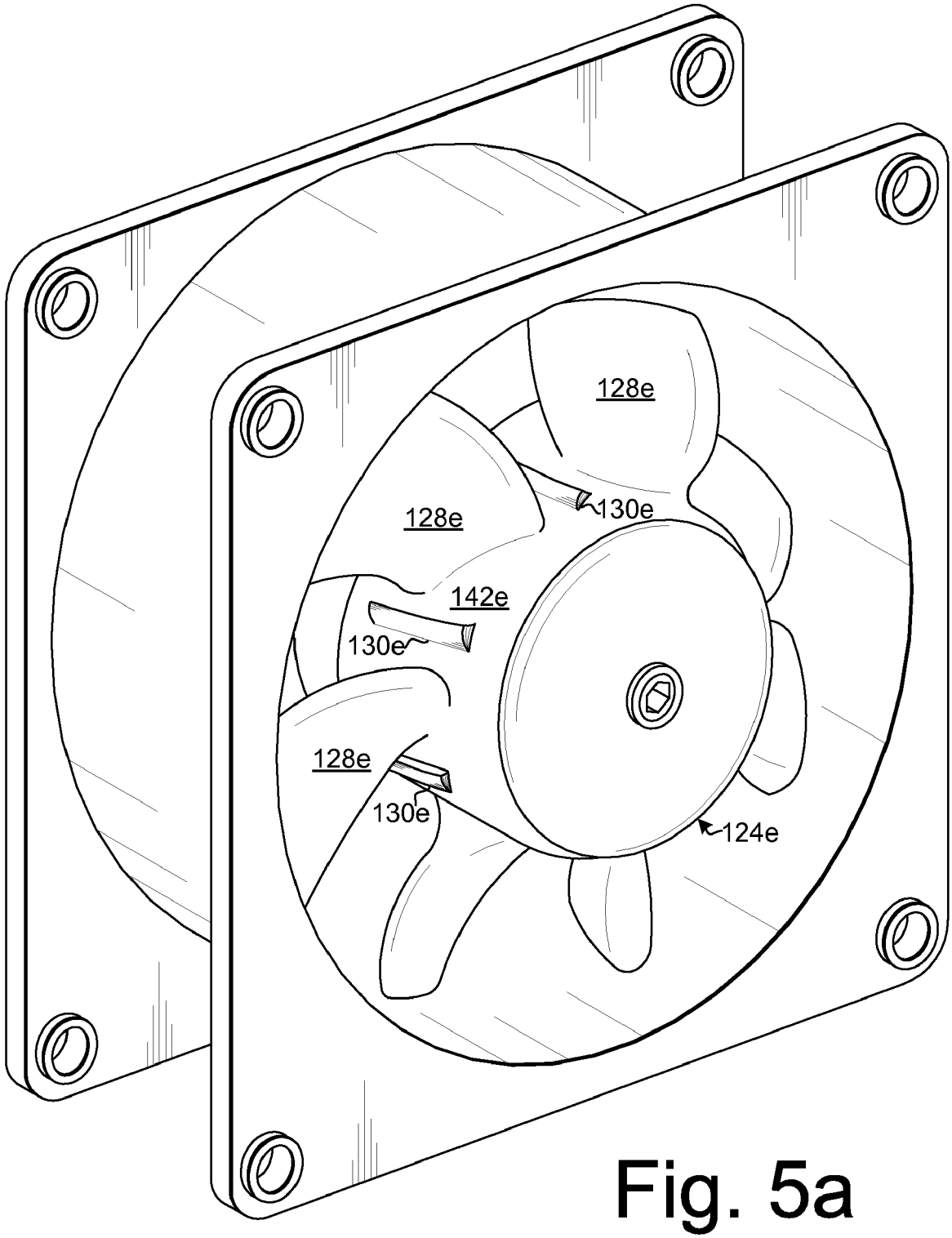
FIG. 5*a* illustrates a perspective view of an exemplary fan unit in accordance with one embodiment of the inventive concepts.

FIGS. 4 and 5*a* illustrate perspective representations of additional exemplary fan unit configurations. In these embodiments, the impeller hub has multiple blades as well as multiple scoops positioned on the hub's second surface. In FIG. 4, hub 124*d* has multiple blades 128*d* and multiple scoops 130*d* positioned on second surface 142*e*. Similarly in FIG. 5*a*, hub 124*e* has multiple blades 128*e* and multiple scoops 130*e* positioned on second surface 142*e*. The scoops can force air into the fan unit's internal volume as can be evidenced from FIG. 5*b*.

Figure 5B:
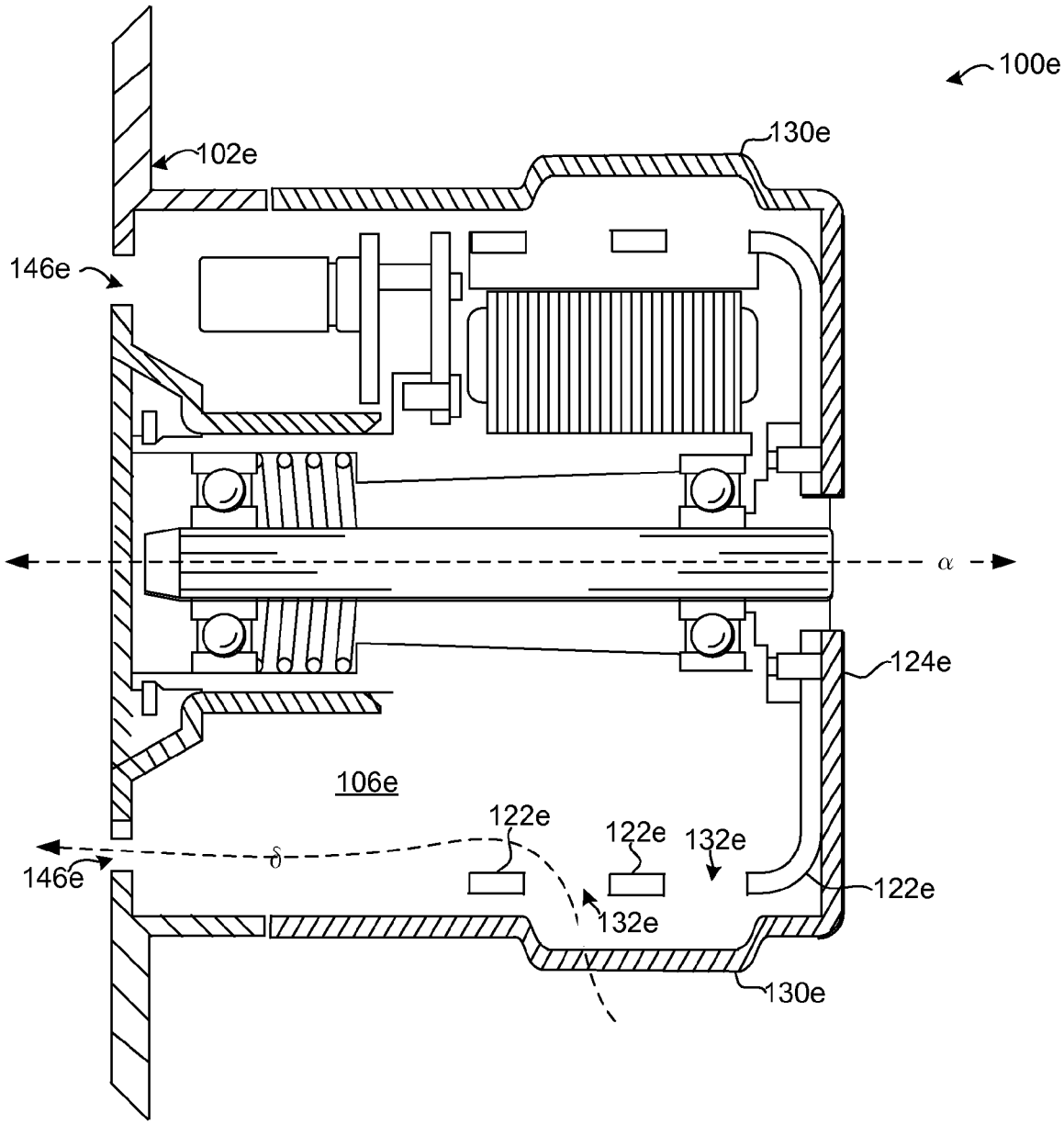
FIG. 5*b* illustrates a cross-sectional view of an exemplary fan unit in accordance with one embodiment of the inventive concepts.

FIG. 5*b* illustrates a cross-sectional view of fan unit 100*e* similar to that illustrated in FIG. 1*c*. Scoop 130*e* is respectively aligned with holes 132*e* in cup 122*e* so that rotation of impeller 104*e* forces air into internal volume 106*e*. In this embodiment, the air can leave the internal volume through exit opening 146*e* formed in housing 102*e*. While the embodiments described above position scoops on either the first or second hub surfaces, other embodiment may position scoops on both the first and second surfaces.

Figure 6A:
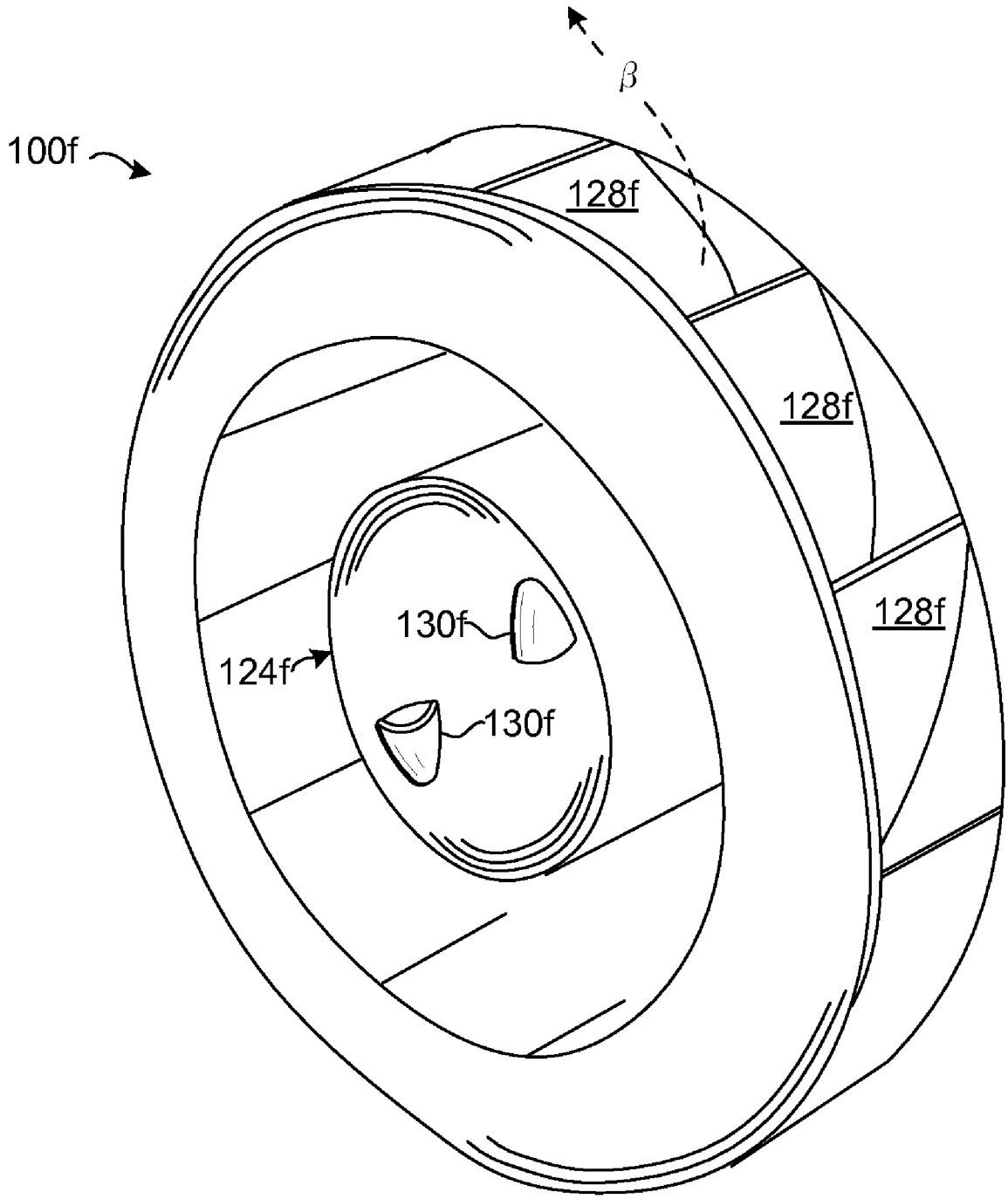
FIG. 6*a* illustrates a perspective view of an exemplary fan unit in accordance with one embodiment of the inventive concepts.
Figure 6B:
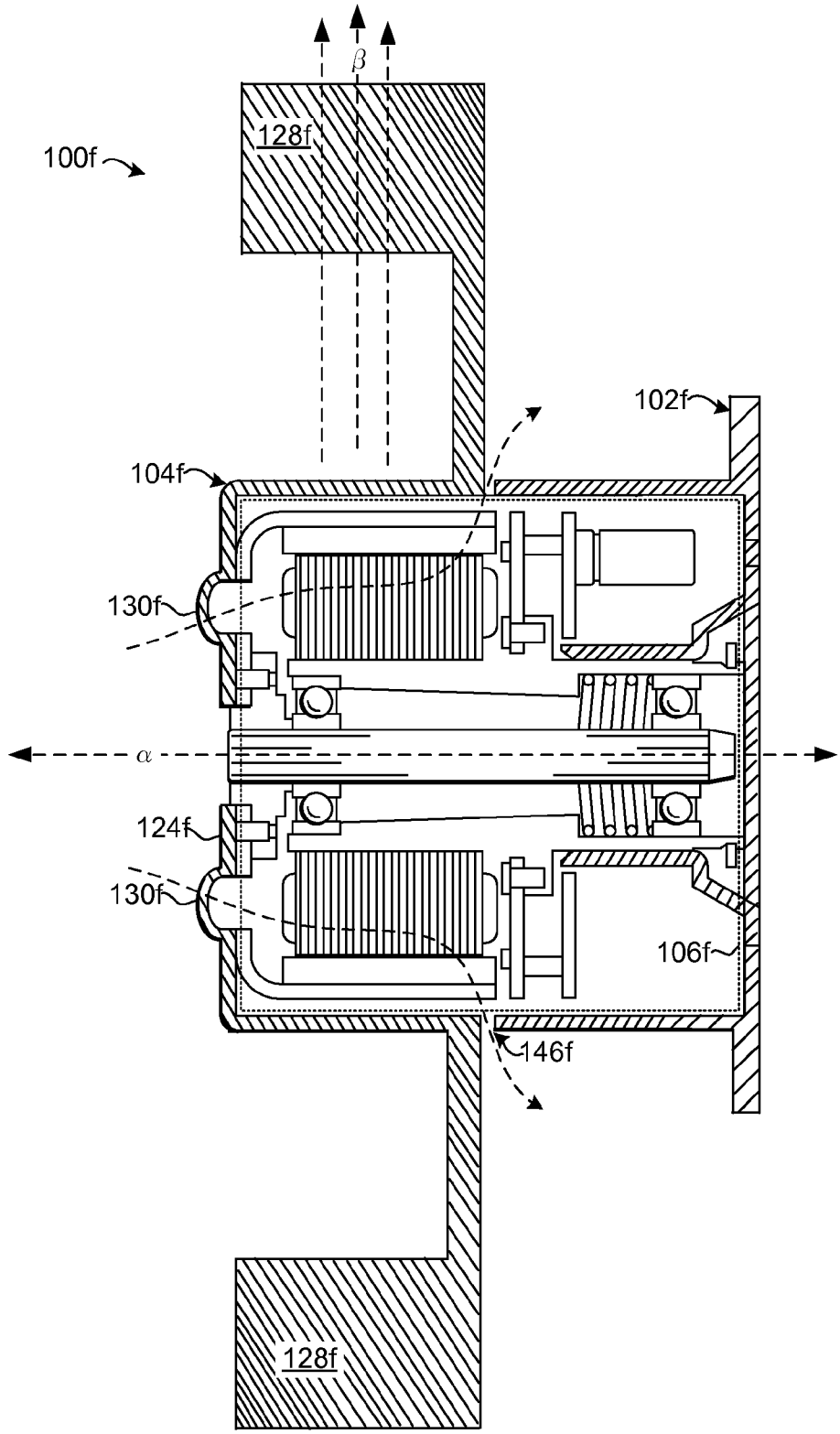
FIG. 6*b* illustrates a cross-sectional view of an exemplary fan unit in accordance with one embodiment of the inventive concepts.

FIGS. 6*a*-6*b* illustrate another exemplary fan unit 100*f*. FIG. 6*a* represents a perspective view while FIG. 6*b* illustrates a cross-sectional view taken parallel to an intersecting the fan units axis of rotation. In this embodiment, rotation of hub 124*f* around axis of rotation a causes blades 128*f* to move air generally outwardly and away from the axis of rotation as indicated generally by arrows β. Scoops 130*f* force air into the internal volume 106*f*. Air can leave the internal volume via exit opening 146*f* between impeller 104*f* and housing 102*f*.

Figure 7A:
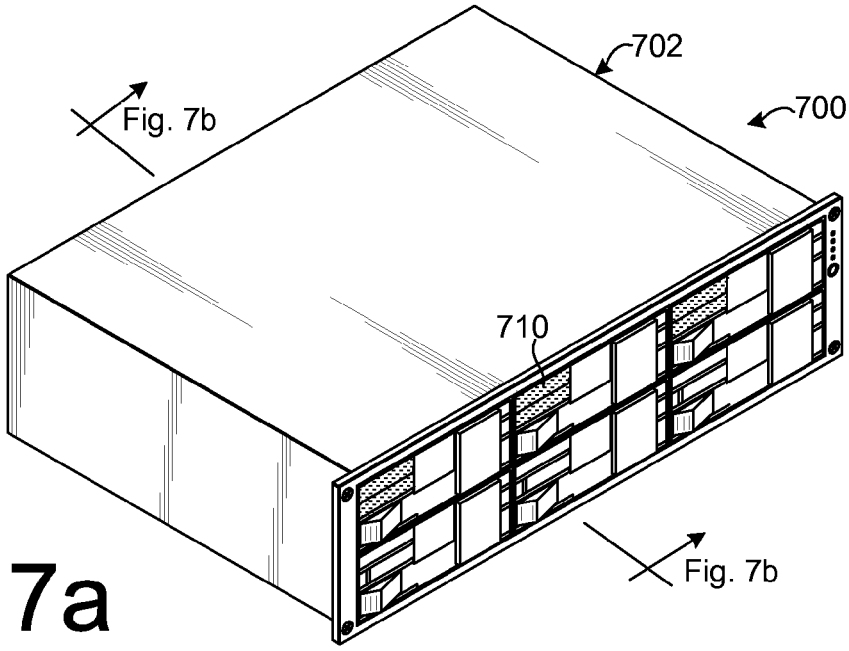
FIG. 7*a* illustrates a perspective view of an exemplary computer system in accordance with one embodiment of the inventive concepts.
Figure 7B:
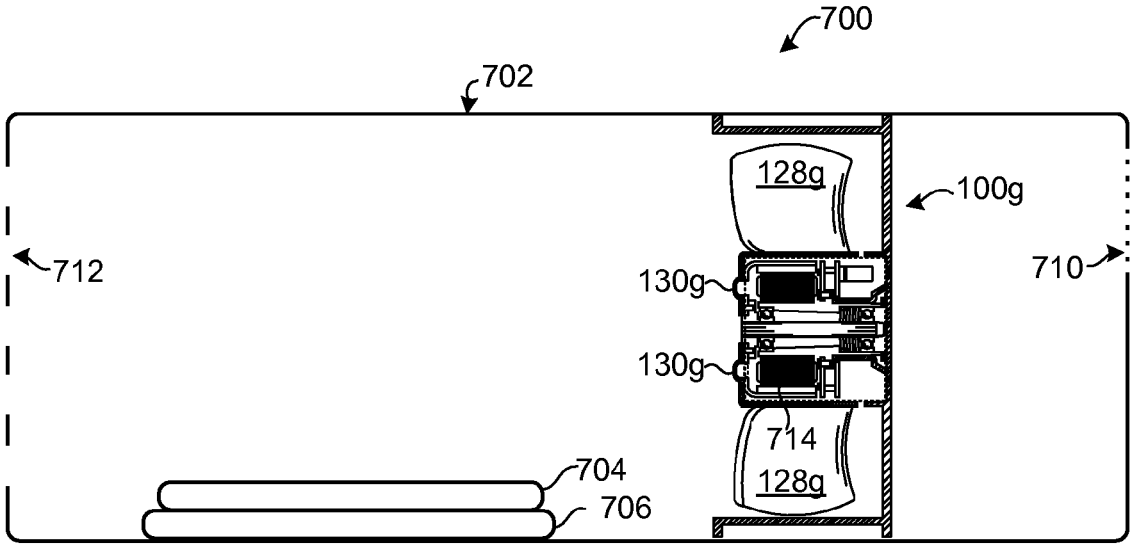
FIG. 7*b* illustrates a cross-sectional view of an exemplary computer system in accordance with one embodiment of the inventive concepts.

FIGS. 7*a*-7*b* illustrate an exemplary system 700 embodied as a consumer device. FIG. 7*a* represents a perspective view while FIG. 7*b* illustrates a cross-sectional view as indicated in FIG. 7*a*. A consumer device is any device which can be purchased for personal and/or business use. In this embodiment the consumer device comprises a computing device in the form of a server. Other computing devices can include personal computers, both desktop and notebook versions.

System 700 comprises a chassis 702 supporting at least one electrical component. In this particular embodiment the electrical components comprise a processor 704 coupled to a printed circuit board 706. This is but one example of electrical components that can be supported by chassis 702. Other electrical components can range from transistors and resistors to hard drives and digital versatile disk players/recorders. In this embodiment, chassis 702 has ventilation areas 710, 712 formed at generally opposing ends of the chassis to allow air movement through the chassis. This is but one suitable configuration; the skilled artisan should recognize many other chassis configurations. Fan unit 100*g* is positioned proximate chassis 702 to create air movement within and/or through the chassis by means of blades 128*g*. In this particular embodiment, fan unit 100*g* is positioned within the chassis 702, but other configurations may also allow the fan unit to be positioned outside the chassis. For example, the fan unit could be positioned outside of chassis 702 but proximate to ventilation area 712 sufficiently to create air movement within the chassis.

Operating temperatures within chassis 702 may be above those of the ambient environment. Such elevated temperature can be due, at least in part, to heat generation from processor 704 and/or printed circuit board 706. When the fan unit's motor, indicated generally at 714, functions to turn blades 128*g*, the motor generates heat which may not be easily dissipated away from the motor due, at least in part, to the elevated temperatures. Scoops 130*g* are configured to force air past motor 714. As such, the scoops can provide heat dissipation to the motor.

CONCLUSION

The described embodiments relate to fan units having a means for cooling an internal environment of the fan unit. The fan units can comprise a housing and an impeller configured to move relative to the housing. The housing can define the internal environment or internal volume containing the fan motor. The impeller can have a first structure, such as a blade, configured to move air past the housing and a second different structure, such as a scoop, configured to force air into, and through, the internal environment to increase heat dissipation of the internal environment.

Although the inventive concepts have been described in language specific to structural features and/or methodological steps, it is to be understood that the inventive concepts in the appended claims are not limited to the specific features or steps described. Rather, the specific features and steps are disclosed as forms of implementing the inventive concepts.

The invention claimed is:

1. A fan unit comprising:

a housing defining an internal volume and supporting a motor in the internal volume; and, an impeller coupled to the motor and configured to rotate in relation to the housing, wherein the impeller comprises a plurality of blades configured to move air past the housing and at least one pair of scoops configured to force air into the internal volume;

wherein each scoop of each pair of scoops is defined in a surface of a hub of the impeller, wherein the surface of the hub is generally transverse to an axis of rotation of the impeller, and wherein each scoop is an approximate conoid in shape;

wherein the conoid shape of each scoop defines an opening that is radially offset from the axis of rotation of the impeller, wherein rotation of the hub causes rotation of the scoops in a circular path, and wherein rotation of the scoops causes air to enter the opening by movement that is generally orthogonal to the axis of rotation of the impeller;

wherein the surface of the hub defines a hole adjacent to each scoop to allow passage of air, forced by the adjacent scoop, into the housing;

wherein each pair of the at least one pair of scoops consists of two scoops in an inverse symmetrical relationship to each other; and wherein the impeller and housing are separated by a gap, and wherein the gap allows the air forced into the housing to exit from the housing.

2. The fan unit as recited in claim 1, wherein a portion of the housing is generally cylindrical and parallel to the axis of rotation.

3. The fan unit as recited in claim 1, wherein the gap between the impeller and the housing exhausts air in a radially oriented direction relative to the axis of rotation.

4. A consumer device embodying the fan unit of claim 1.

5. An impeller comprising:

a hub configured to be rotated by a motor;

a plurality of blades coupled to the hub and configured to move air past the hub;

at least one pair of scoops configured to force air into the hub when the hub is rotated, wherein the at least one pair of scoops is defined in a surface of the hub of the impeller, wherein the surface of the hub is generally transverse to an axis of rotation of the impeller, and wherein each pair of the at least one pair of scoops comprises two scoops in an inverse symmetrical relationship to each other;

an opening defined by each scoop, wherein the opening is radially offset from the axis of rotation of the impeller, wherein rotation of the hub causes rotation of the opening defined by each scoop in a circular path, and wherein rotation of the scoops causes air to enter the opening by movement that is generally orthogonal to the axis of rotation of the impeller;

holes defined in the surface of the hub adjacent to each scoop to allow passage of air, forced by the adjacent scoop, into the hub; and a gap, defined in the hub to allow air to exhaust from the hub, wherein the air forced by the scoops into the hub exits the impeller through the gap after flowing by the motor of the impeller, wherein the gap is downstream from air moved by the blades.

6. A system comprising:

an impeller;

a means on the impeller, comprising a plurality of blades, for moving air outside the impeller when the impeller is rotated; and, a means on the impeller for moving air within the impeller, comprising at least one pair of scoops defined in a surface of a hub of the impeller, wherein the surface is generally transverse to an axis of rotation of the impeller, wherein each scoop is an approximate conoid in shape, wherein each pair of the at least one pair of scoops comprises two scoops in an inverse symmetrical relationship to each other, and wherein the means on the impeller for moving air within the impeller comprises:

an opening defined by each scoop, wherein the opening is defined by the conoid shape of each scoop, wherein the opening is radially offset from the axis of rotation of the impeller, wherein rotation of the hub causes rotation of the opening defined by each scoop in a circular path, and wherein rotation of the scoops causes air to enter the opening by movement that is generally orthogonal to the axis of rotation of the impeller;

holes defined in the surface of the hub adjacent to each scoop to allow passage of air, forced by the adjacent scoop, into the impeller; and a gap, defined in the hub to allow air to exhaust from the hub, wherein the air forced by the scoops into the impeller exits the impeller through the gap after flowing by the motor within the impeller, wherein the gap is downstream from air moved by the blades, and wherein a spring located coaxially with the axis of rotation of the impeller regulates a size of the gap.

* * * * *